US006575253B2

(12) United States Patent
Han et al.

(10) Patent No.: US 6,575,253 B2
(45) Date of Patent: Jun. 10, 2003

(54) AUTOMATIC HAMMER SYSTEM FOR STANDARD PENETRATION TEST

(75) Inventors: Il Yeong Han, Seoul (KR); Bum Sang Kim, Seoul (KR); Ki Young Kim, Seoul (KR)

(73) Assignee: SK Engineering & Construction Ltd., Seoul (KR)

( * ) Notice: Subject to any disclaimer, the term of this patent is extended or adjusted under 35 U.S.C. 154(b) by 0 days.

(21) Appl. No.: 10/211,038

(22) Filed: Aug. 1, 2002

(65) Prior Publication Data

US 2003/0024713 A1 Feb. 6, 2003

(30) Foreign Application Priority Data

Aug. 2, 2001 (KR) ..... 2001-46701

(51) Int. Cl.[7] ..... B25D 9/00
(52) U.S. Cl. ..... 173/2; 173/89; 173/124
(58) Field of Search ..... 173/89, 29, 124, 173/132, 28, 21, 2

(56) References Cited

U.S. PATENT DOCUMENTS

| | | | | |
|---|---|---|---|---|
| 3,894,426 A | | 7/1975 | Kopf | 73/82 |
| 3,934,656 A | | 1/1976 | Pappert | 173/124 |
| 4,405,020 A | | 9/1983 | Rassieur | 173/89 |
| 4,977,965 A | * | 12/1990 | Rupe | 173/89 |
| 4,993,500 A | * | 2/1991 | Greene et al. | 173/124 |
| 5,303,162 A | * | 4/1994 | Yoon | 173/2 |
| 5,330,011 A | * | 7/1994 | Powell | 173/89 |
| 5,607,022 A | * | 3/1997 | Walker et al. | 173/89 |
| 6,003,619 A | * | 12/1999 | Lange | 173/89 |
| 6,508,313 B1 | * | 1/2003 | Carney et al. | 173/2 |

* cited by examiner

*Primary Examiner*—Scott A. Smith
(74) *Attorney, Agent, or Firm*—Sheridan Ross PC

(57) ABSTRACT

A hammer system for automatically carrying out a standard penetration test is disclosed. A cylindrical housing, in which an anvil coupled to a drill rod is received, is supported by a first hydraulic cylinder coupled to boring equipment. A cylindrical hammer is received in the housing. The hammer includes a holding assembly therein, which selectively holds and raises the hammer by a second hydraulic cylinder. Element for limiting a stroke of the hammer is spacedly connected to the holding assembly to be raised and lowered therewith. The limiting element includes a first sensor to detect a slot formed at the housing when the hammer is raised, thereby counting the number of blows. The hammer includes a plurality of protrusions on its outer surface. A wall of the housing includes a second sensor to detect the number of protrusions passed over the second sensor when the hammer is raised, thereby calculating a penetration depth from a difference between the numbers of protrusions detected for two continuous blows.

9 Claims, 13 Drawing Sheets

- PRIOR ART -

AUTOMATIC HAMMER SYSTEM FOR STANDARD PENETRATION TEST

BACKGROUND OF THE INVENTION

1. Field of the Invention

The present invention relates to an apparatus for carrying out a Standard Penetration Test (SPT) to determine the penetration resistance, geological distribution and nature of the soil, and more particularly to an automatic hammer system for a standard penetration test, which enables its hammer to fall from a precise predetermined height regardless of a penetration depth of a sampler, and is able to automatically carry out sequential test procedures such as counting the number of blows by the hammer and a penetration depth of a sampler according to the number of blows.

2. Description of the Prior Art

To undertake various civil engineering works and construction works, there is a need to first determine the penetration resistance, geological structure and geological composition of the soil by checking consistency and relative density of the soil by testing the soil of an area in question. To this end, a test procedure known as the "Standard Penetration Test" is commonly used.

The standard penetration test is a representative geological surveying test for estimating soil constants such as strength, relative density and angle of internal friction of ground in question, which is carried out as follows. A hammer of 63.5 kg is raised to a height of 75 cm and then released to fall and impact a split barrel sampler (referred to merely as a sampler, hereinafter), and this procedure is repeatedly carried out until the soil is penetrated to a depth of 30 cm by the sampler. Subsequently, an N value, which is the number of blows of the hammer counted until the sampler penetrates the soil to the depth of 30 cm, is calculated, and the soil constants of the ground are obtained from the N value.

In this test, the number of blows counted until the sampler initially penetrates the soil to a depth of 15 cm is regarded as a number of preliminary blows because the soil sample is believed to be disturbed, and the number of blows counted until the sampler further penetrates the soil to a depth of 30 cm from the level corresponding to the initial depth of 15 cm is determined as the N value for the soil in question. Where the number of blows counted until the sampler penetrates the soil to the depth of 30 cm exceeds 50, a depth of the soil penetrated after the hammer gives the sampler 50 blows is measured.

As a rule, though the standard penetration test must be carried out every 1.5 m under the current ground surface, the standard penetration test is carried out only once where the same geological formation continues underground.

Referring to FIG. 1, there is shown the most common apparatus for use in the standard penetration test, which uses a winch.

As shown in the drawing, a frame 1 is provided at its lower portion with a winding drum 2 fixed thereto, and is provided at its upper portion with a pulley 3. A rope 4 is wound around the winding drum 2 for several turns and wrapped around the pulley 3 to be directed downwardly. A cylindrical hammer 5 is coupled to one end of the rope 4, and slidably inserted over a vertical guide rod 6.

The guide rod 6 is coupled at its lower end to a drill rod 8, which is inserted into a boring hole (not shown) which has been previously drilled. The drill rod 8 is provided at its upper end with an anvil 7 mounted thereon, on which the hammer 5 impacts, and is provided at its lower end with a sampler (not shown) coupled thereto to obtain a disturbed soil sample. The guide rod 6 is provided with a marking which indicates a maximum lifting height at a certain height from the anvil 7.

In an operation of the winch-type apparatus, the drill rod 8, on which the sampler is mounted, is inserted into the boring hole of the soil, and then coupled to the guide rod 6. Subsequently, the rope 4 is pulled by an operator to raise the hammer 5 to the lifting height (75 cm), and then released to allow the hammer 5 to free fall. Consequently, the hammer 5 falls along the guide rod 6 and impacts the anvil 7.

Therefore, the impact of the falling hammer 5 is transmitted to the drill rod 8 through the anvil 7, so that the soil in question is penetrated by the sampler coupled to the lower end of the drill rod 8. This procedure is repeated until the penetrated depth reaches a desired value.

However, since such a conventional winch-type apparatus for use in the standard penetration test is required for an operator to check, with his naked eye, a lifting height of the hammer 5 during every lifting procedure, it is difficult to maintain a constant lifting height throughout all the striking procedures even though the test is carried out by a skilled person. Hence, the drill rod is applied with different impact strengths throughout the striking procedures.

Furthermore, since the hammer 5 is raised by the rope 4, frictional loss is generated between the winding drum 2 and the pulley 3 during the falling of the hammer 5. The frictional loss varies depending on the properties and age of the rope 4, and actual impact strength applied to the anvil 7 is reduced to a value lower than the specified value.

Therefore, the conventional winch-type apparatus is inadequate to carry out the standard penetration test, and it is difficult to assure a precise measurement of an N value and to assure reliability of test results because of various factors.

In addition, since an N value obtained by the test is in an operator's memory, and a penetration depth of the sampler is obtained by an additional measuring procedure, an operator is apt to obtain incorrect test results, and considerably different test results may be obtained depending on operators even though the tests are carried out on the same soil sample.

To overcome the above-mentioned problems, a drive hammer system for a standard penetration test is disclosed in U.S. Pat. No. 4,405,020, which is adapted to enable a hammer to consistently fall from the same height, and to minimize frictional loss generated during the falling of the hammer.

The drive hammer system is slidably supported to an outer surface of a hydraulic cylinder via a pivot arm connected to a piston rod of the hydraulic cylinder. The hydraulic cylinder is vertically mounted on a drill rig. The pivot arm is rotated to a working position and raised by the hydraulic cylinder to be positioned over an impact surface of an anvil. When the drive hammer system is positioned over the anvil, a shutoff valve is opened to allow fluid in the hydraulic cylinder to be exhausted.

In this state, by actuation of a motor mounted on the cylindrical housing, a sprocket is rotated to cause a chain to be rotated clockwise. Lifting lugs on the chain are raised along a slot axially formed at the cylindrical housing by the rotation of the sprocket. At this point, the lug comes into contact with a lower end of a hammer received in the housing. As the lug pushes the hammer up, the hammer is gradually distanced from the anvil.

When the lug reaches the sprocket and begins to move outwardly, the lug moves from under the hammer, permitting the hammer to free fall until it strikes the impact surface of the anvil. By the striking action of the hammer against the anvil, a sampler penetrates the soil, thereby allowing the anvil to be lowered. At this point, the cylindrical housing free falls by the penetration depth of the sampler, and thus is placed on a flange of a drill rod, thereby maintaining a drop height at a certain value.

The drive hammer system itself is lowered by the penetration depth after every blow so as to maintain the drop height of the hammer at a certain value. However, since the drive hammer system strikes the flange of the drill rod soon after blows from the hammer (i.e. secondary blows), the sampler further penetrates the soil.

In addition, since the hammer is adapted to be raised by the lifting lug of the turning chain and to fall by release from the lug, the hammer may be raised to a position higher than the specified height by being struck by the lug in the course of turning when the chain is rotated at high speed.

In addition to this, it is troublesome to measure a penetration depth of the sampler by blows of the hammer by an additional measuring device.

Accordingly, this drive hammer system is not able to assure accuracy and reliability of an N value.

SUMMARY OF THE INVENTION

Accordingly, the present invention has been made keeping in mind the above problems occurring in the prior art, and an object of the present invention is to provide an automatic hammer system for use in a standard penetration test, which is adapted to enable a hammer to be raised and to fall automatically, and which is adapted to maintain a drop height of a hammer at a certain value, regardless of a penetration depth of a sampler.

Another object of the present invention is to provide an automatic hammer system for use in a standard penetration test, which is able to minimize loss of impact energy of a hammer caused by frictional contacts between associated components, and which is adapted to reliably prevent secondary blows against an anvil, thereby permitting the anvil to always be applied with a specified impact energy.

A further object of the present invention is to provide an automatic hammer system for use in a standard penetration test, which is adapted to automatically carry out a series of test procedures for counting the number of blows by a hammer and a penetration depth of a sampler according to the number of blows, thereby affording a precise N value.

In order to accomplish the above object, the present invention provides an automatic hammer system for a standard penetration test, comprising: a first vertical hydraulic cylinder rotatably coupled to boring equipment; a cylindrical housing positioned to be parallel to the first hydraulic cylinder and coupled thereto, the cylindrical housing being connected to a piston rod of the first hydraulic cylinder and adapted to receive therein an anvil of a drill rod, wherein the drill rod is provided at its lower end with a sampler to be inserted in a boring hole of the soil; a cylindrical hammer with a blind lower end, which is movably received in the housing to be disposed over the anvil; a holding assembly received in the hammer and adapted to hold the hammer at its lower dead point and to release the hammer at its upper dead point to allow the hammer to fall; a second hydraulic cylinder concentrically coupled to an upper end of the housing and adapted to raise and lower the holding assembly; means for limiting a lifting height of the hammer, which is received in the housing to be disposed over the hammer and integrally coupled to the holding assembly with a spacing therebetween, the limiting means being raised and lowered within a certain range; means for counting the number of blows of the hammer against the anvil; means for measuring a penetration depth of the sampler by blows of the hammer; and a control unit for carrying out control of the striking action of the hammer and calculation of an N value according to data obtained by the counting means and the measuring means, and for carrying out record and display of test results.

According to an aspect of the present invention, the holding assembly includes a cylindrical casing which is radially provided at its wall with a plurality of fitting slots at a certain angular spacing, a plurality of holding blocks slidably fitted in the fitting slots of the casing and adapted to selectively press an inner surface of the hammer, and a pusher unit received in the casing and connected to the piston rod of the second hydraulic cylinder, the pusher unit being adapted to outwardly push or release the holding blocks in the course of axial movement.

The pusher unit is adapted to outwardly push and release the holding blocks when the pusher unit is further lowered and raised after the limiting means is stopped.

According to another aspect of the present invention, the counting means comprises a detection slot formed at an upper portion of the housing, and a first sensor mounted on the plunger to detect the detection slot to count the number of blows by the hammer.

According to a further aspect of the present invention, the measuring means comprises a plurality of protrusions axially formed along an outer surface of the hammer at a certain pitch, and a second sensor mounted on a wall of the housing to detect the number of protrusions passed over the second sensor during every lifting motion, thereby enabling a penetration depth to be obtained from the number of protrusions.

According to the present invention, the holding assembly is actuated to outwardly press an inner surface of the elongated cylindrical hammer, thereby firmly holding the hammer. The holding assembly engaging the hammer is raised by the second hydraulic cylinder and then releases the hammer to fall freely. After a blow by the hammer, since the holding assembly holds the hammer at a position which is higher than the previous holding position by a penetration depth of the previous blow, a drop height of the hammer is uniformly maintained for every blow, regardless of a penetration depth of the hammer.

Furthermore, since the hammer is adapted to be raised to a certain height and then to fall therefrom without lowering displacement of the hammer system itself, it is possible to reliably prevent secondary blows caused by lowering of a conventional hammer system. Therefore, the anvil can always be applied with specified impact energy.

In addition, since the number of blows by the hammer and penetration depths according to the number of blows are automatically calculated and accumulated, an N value can be precisely obtained, thereby affording improvements in reliability of test results and convenience in testing.

Therefore, the automatic hammer system for a standard penetration test according to the present invention can contribute to improvements in the accuracy, reliability and convenience of a standard penetration test.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE INVENTION

Figure 1:
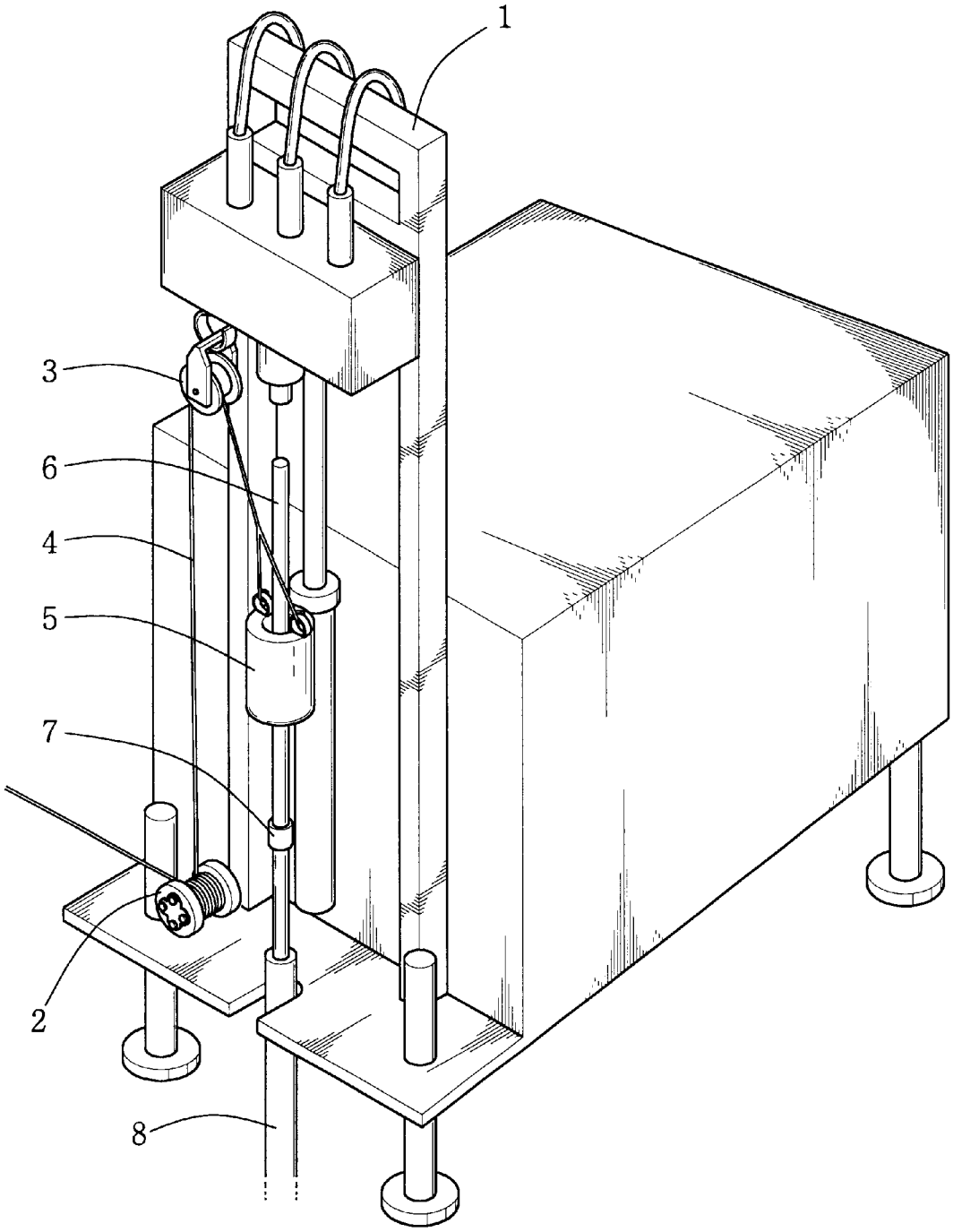
FIG. 1 is a perspective view of a conventional hammer system for use in a standard penetration test.

This invention will be described in further detail by way of example with reference to the accompanying drawings.

As shown in FIGS. 2 to 6, an automatic hammer system for a standard penetration test according to the present invention comprises a first hydraulic cylinder 10, a cylindrical housing 20 adapted to be raised and lowered by the first hydraulic cylinder 10, a hammer 30 received in the housing 20 to be raised and lowered to impact against an anvil 91 coupled to a drill rod 90, a holding assembly 40 adapted to raise the hammer 30 by gripping action and to allow the hammer 30 to fall, a second hydraulic cylinder 50 adapted to raise and lower the holding assembly 40, means 60 for limiting a lifting height of the hammer 30 to a certain height, means 70 for counting the number of blows of the hammer 30, means 80 for measuring a penetration depth of a sampler by blows of the hammer 30, and a control unit for controlling striking action of the hammer 30 and for recording and displaying test results such as N values.

Figure 2:
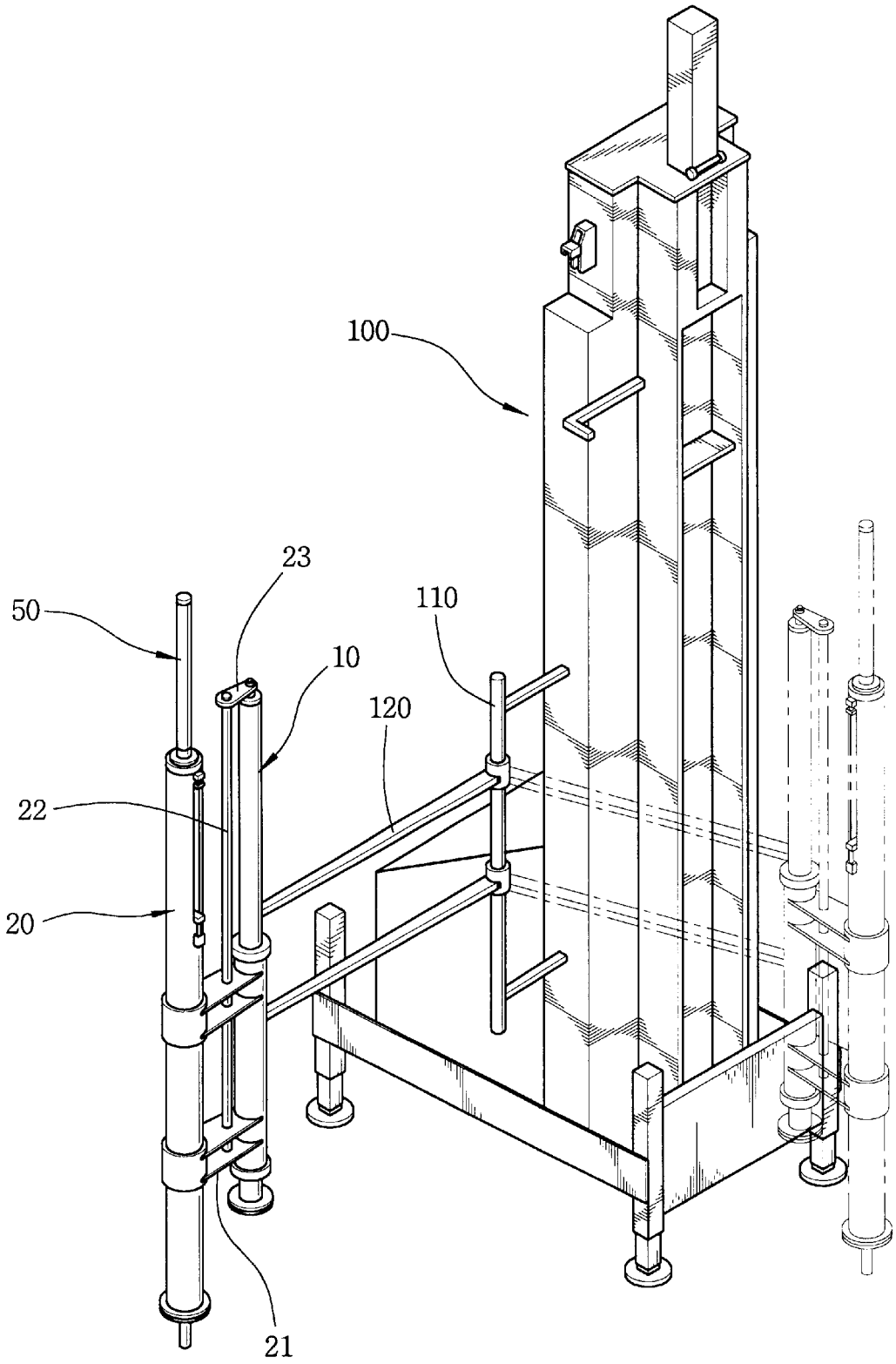
FIG. 2 is a perspective view of an automatic hammer system for a standard penetration test according to the present invention, which is mounted on a boring machine.
Figure 3:
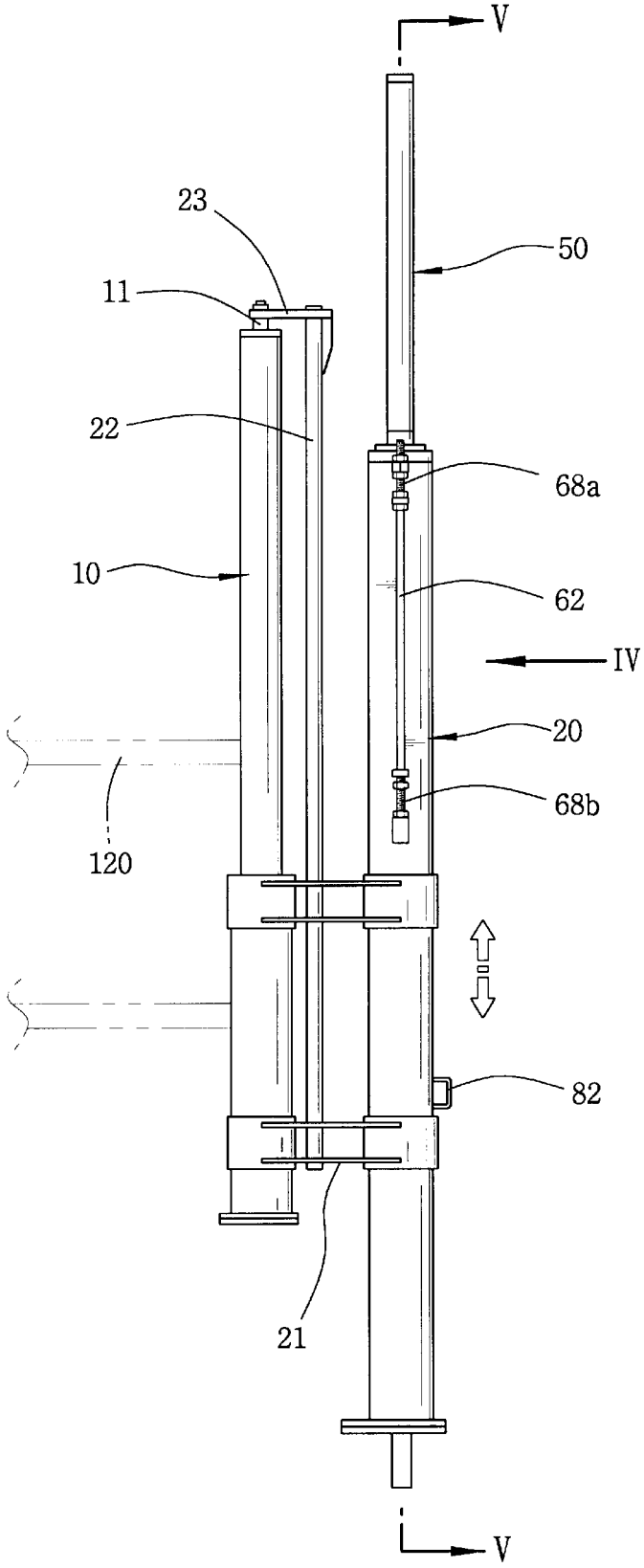
FIG. 3 is a front elevation view of the automatic hammer system for a standard penetration test according to the present invention.
Figure 4:
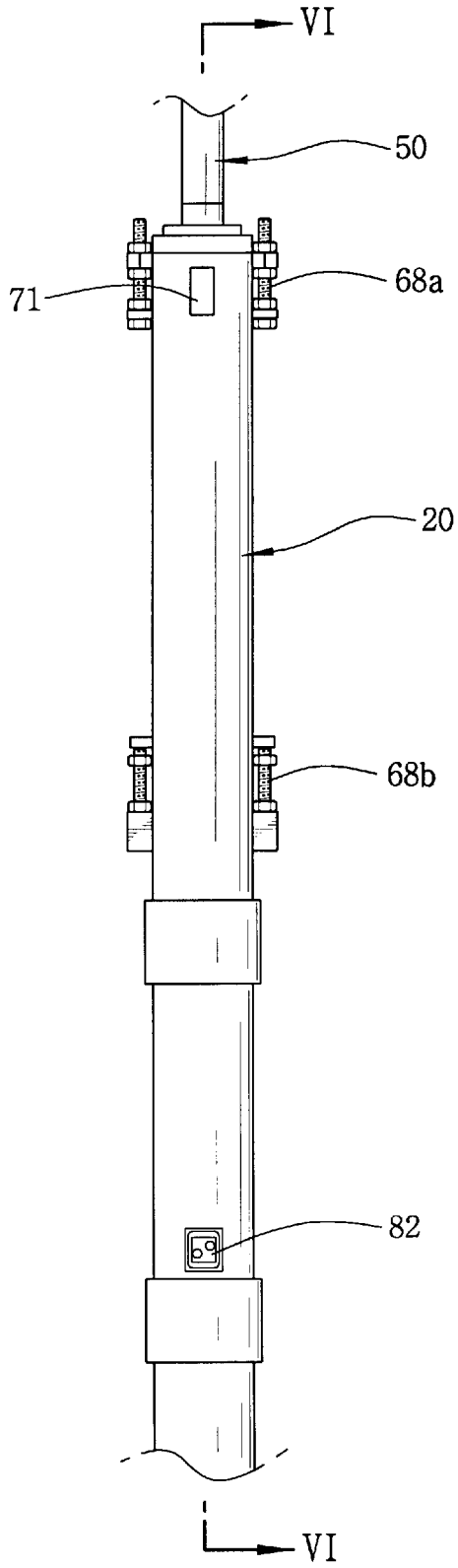
FIG. 4 is a side elevation view taken along line IV—IV of FIG. 3.
Figure 5:
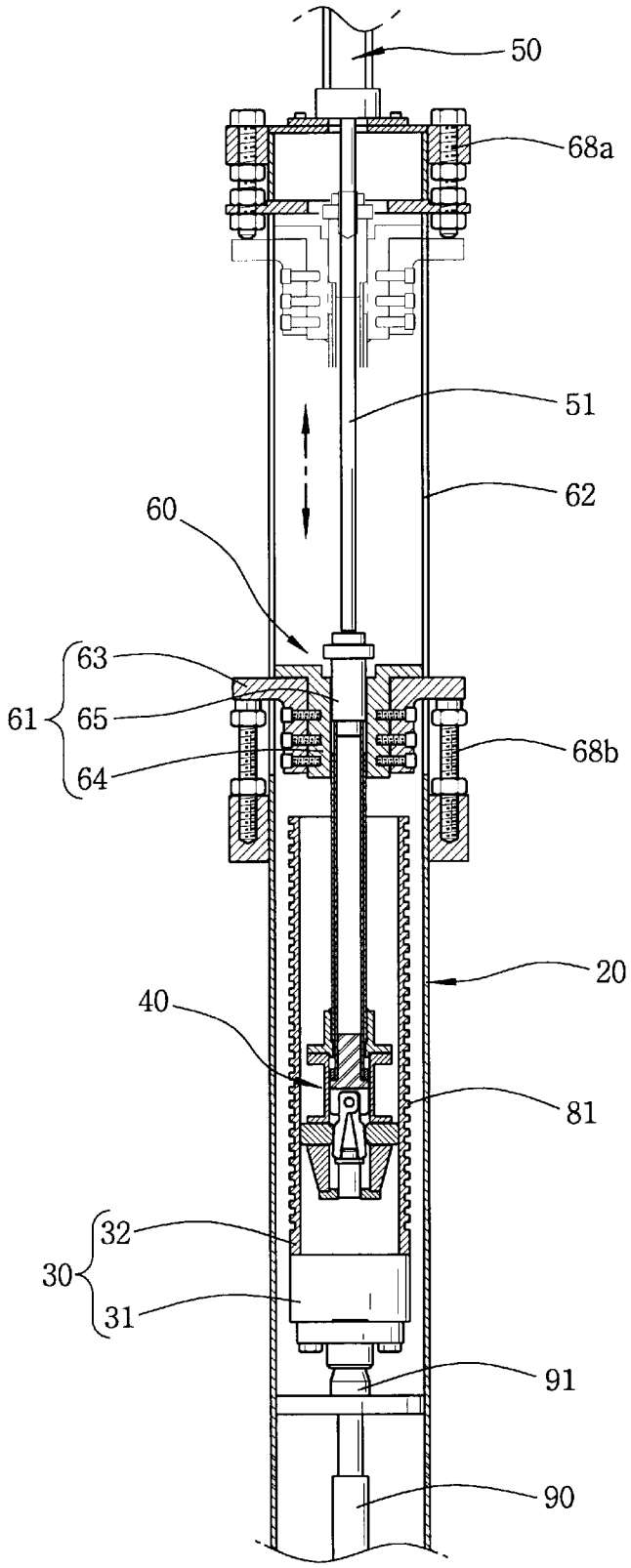
FIG. 5 is a cross-sectional view taken along line V—V of FIG.
Figure 6:
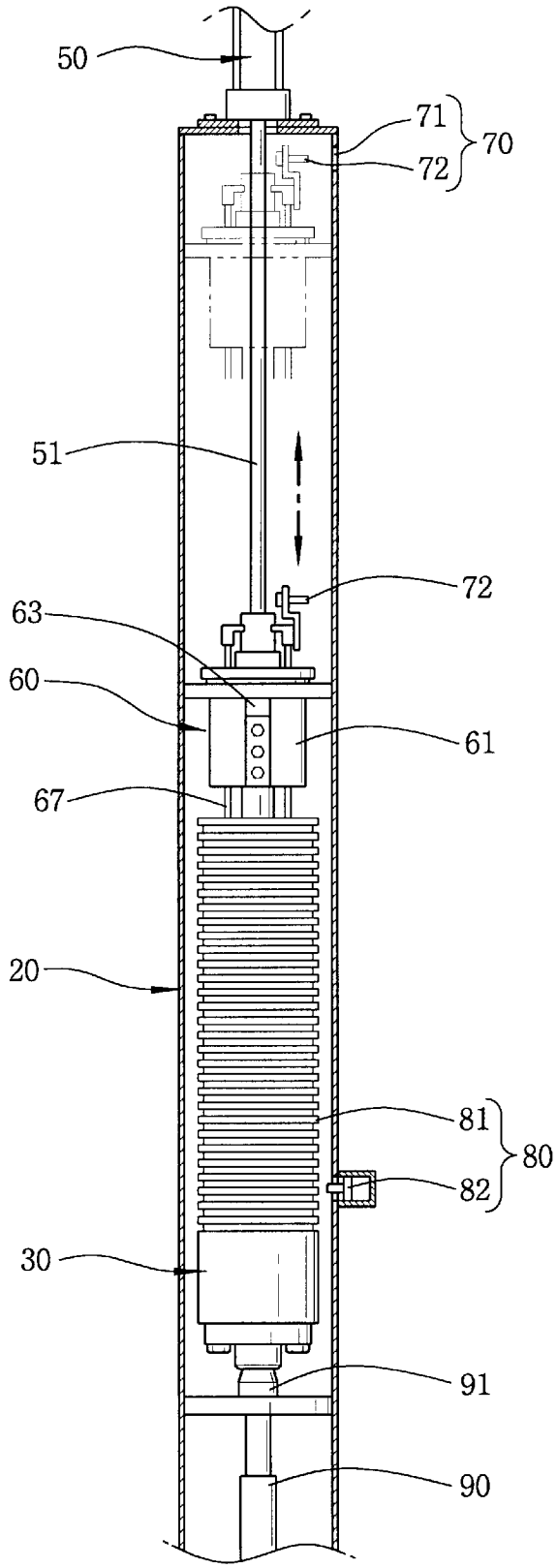
FIG. 6 is a cross-sectional view taken along line VI—VI of FIG. 4.

As shown in FIG. 2, the first hydraulic cylinder 10 is disposed parallel to a vertical support shaft 110, and rotatably coupled to the support shaft 110 via an arm bracket 120. The support shaft 110 is mounted on boring equipment 100, which is adapted to excavate boring holes (not shown) to be used in a soil test.

The housing 20 is coupled to the first hydraulic cylinder 10 by a carrier 21 such that the housing 20 is disposed parallel to the first hydraulic cylinder 10 and is raised and lowered with respect to the first hydraulic cylinder 10. The carrier 21 is slidably inserted at its one end on the first hydraulic cylinder 10, and fixedly coupled at its other end to the housing 20.

A support rod 22 is vertically positioned and fixed to the carrier 21 at its lower end. The upper end of the support rod 22 is connected to an upper free end of a piston rod 11 of the first hydraulic cylinder 10 by a connector 23.

The anvil 91 coupled to the upper end of the drill rod 90 is slidably received in the housing 20 and normally disposed at its lower portion.

The hammer 30 is shaped as an elongated cylindrical form, and is movably received in the housing 20. The hammer 30 is comprised of a striking part 31 positioned at its lower portion to provide blow to the anvil 91, and an elongated cylindrical holding part 32 disposed on the striking part 31 and opened at its upper end to receive the holding assembly 40.

The holding part 32 of the hammer 30 is sized to be longer than a sum of a penetration depth (15 cm) of a sampler (not shown) and a penetration depth (30 cm) of the sampler corresponding to an N value, in which the penetration depth (15 cm) of the sampler is believed to be a depth corresponding to preliminary blows.

Figure 7:
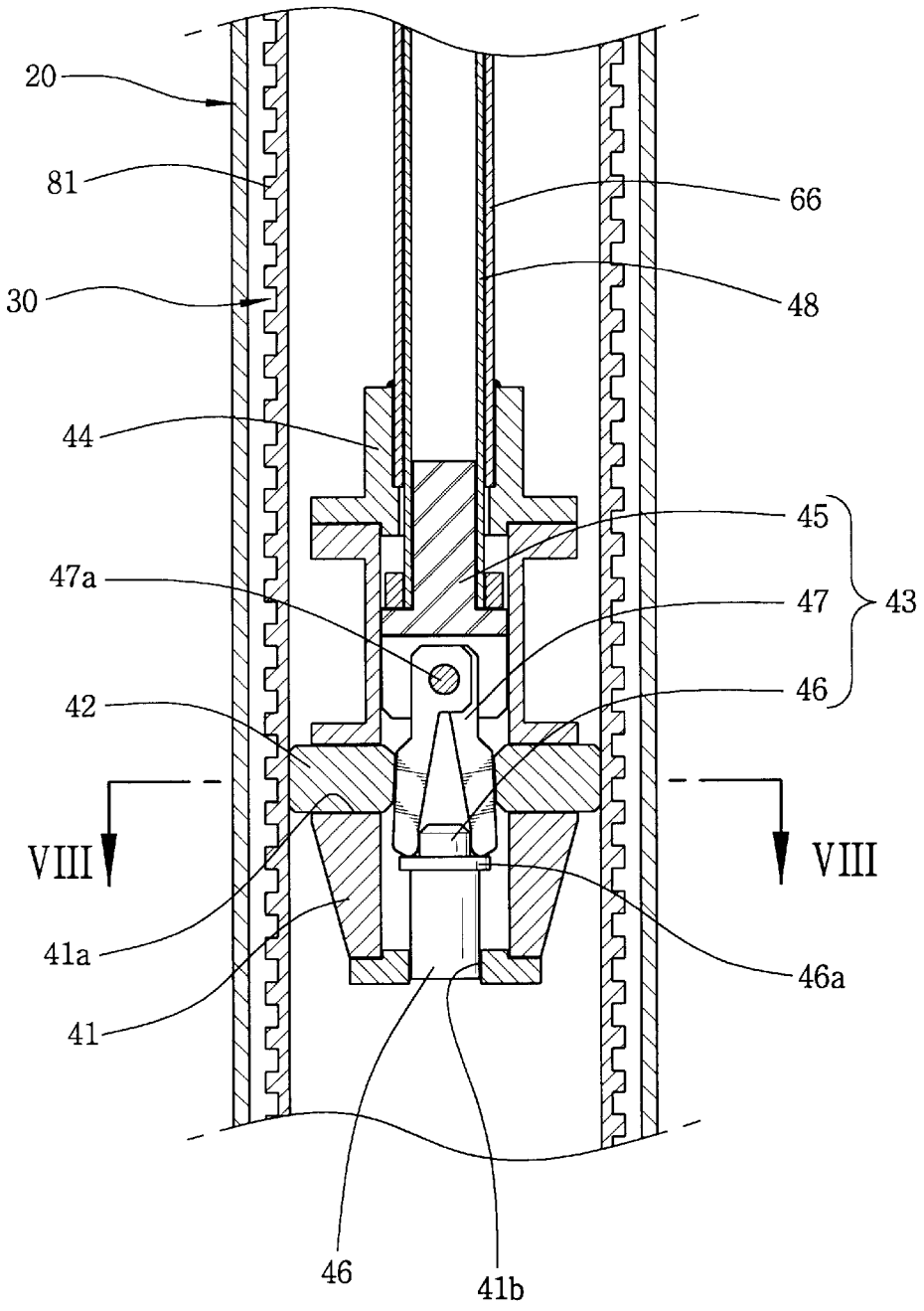
FIG. 7 is an enlarged cross-sectional view of a holding assembly according to the present invention.
Figure 8:
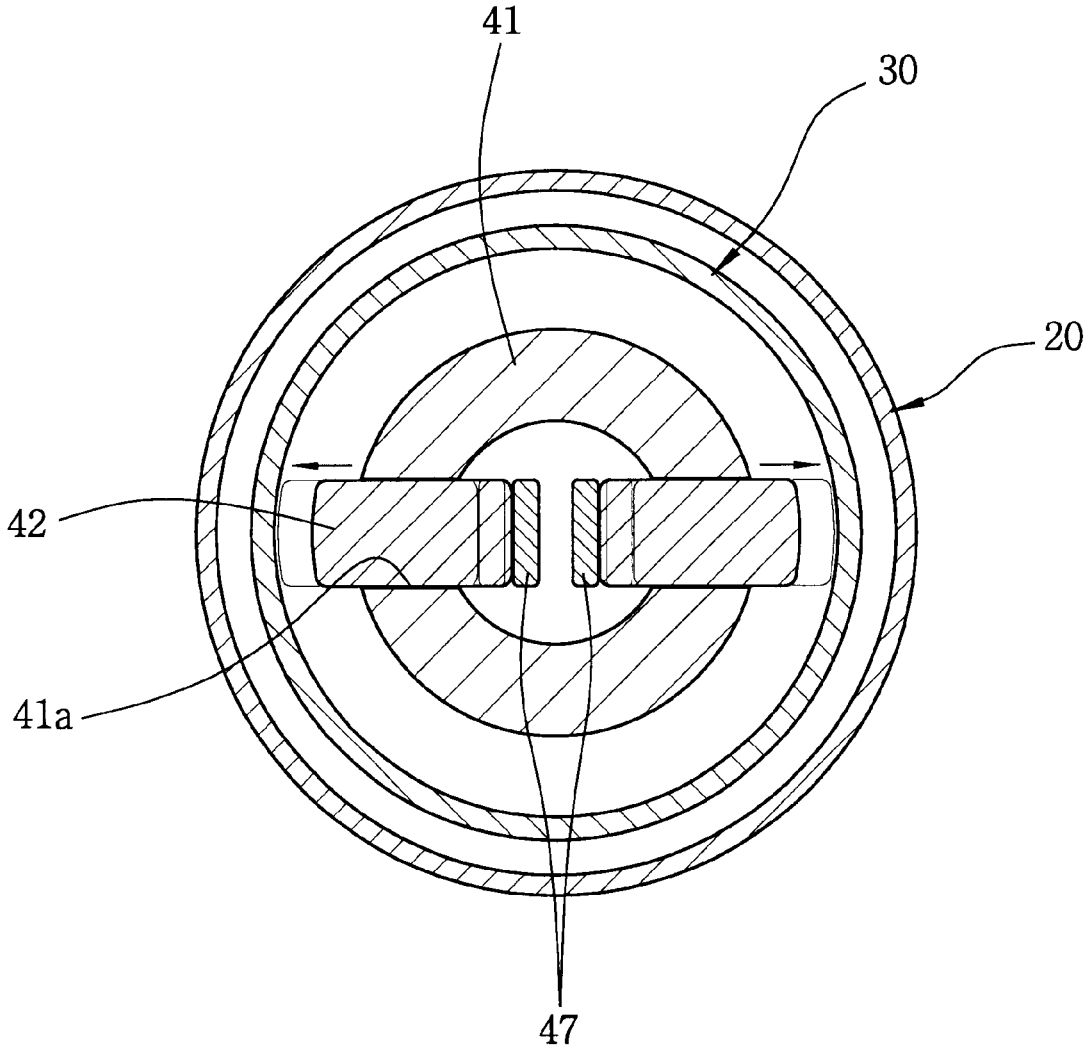
FIG. 8 is a cross-sectional view taken along line VIII—VIII of FIG. 7.

As illustrated in FIGS. 7 and 8, the holding assembly 40 includes a casing which is movably received in the holding part 32 of the hammer 30, a pair of push blocks 42 adapted to radially and outwardly press and release an inner surface of the holding part 32, and a pusher unit 43 adapted to actuate the push blocks 42.

The casing 41 is comprised of a cylindrical body with a blind lower end in which the pusher unit 43 is operatively received. The casing 41 is provided at its upper end with a cap 44 to limit an upward movement of the pusher unit 43 and to prevent separation of the pusher unit 43. The casing 41 is formed with a pair of fitting slots 41*a* at diametrically opposite sides in which the pair of push blocks 42 are fitted.

The pair of push blocks 42 are slidably inserted in the pair of fitting slots 41*a* of the casing 41, so that the outer ends of the push blocks 42 are selectively engaged to an inner surface of the holding part 32 of the hammer 30. Each of the push blocks 42 is sized to be longer than a wall thickness of the casing 41 so that an inner end of the push block 42 is slightly and inwardly protruded from an inner surface of the casing 41.

The pusher unit 43 includes an actuating rod 45 slidably received in the casing 41, a drop head 46 which is fitted in a hole formed at the lower end of the casing 41 to be axially slid, and a dog 47 pivotally connected to a lower end of the actuating rod 45 by a hinge pin 47*a*.

The actuating rod 45 is connected to a piston rod 51 of the second hydraulic cylinder 50, and is raised and lowered in the casing 41.

The drop head 46 is fitted in the hole 41*b* formed at the lower end of the casing 41. The drop head 46 is provided at its outer surface with a flange 46*a*, so that the drop head 46 is hung on the lower end of the casing 41 and properly protruded upwardly and downwardly to open the dog 47.

The dog 47 is elastically biased by a torsion spring (not shown) in a closing direction, and is adapted to be opened by a lowering motion of the actuating rod 45 to receive the drop head 46 at its mouth, thereby pushing the push blocks 42 outwardly.

The second hydraulic cylinder 50 is concentrically connected to an upper end of the housing 20. The piston rod 51 of the second hydraulic cylinder 50 is received in the housing 20, and is connected to the actuating rod 45 of the pusher unit 43 via a connecting pipe 48.

Figure 9:
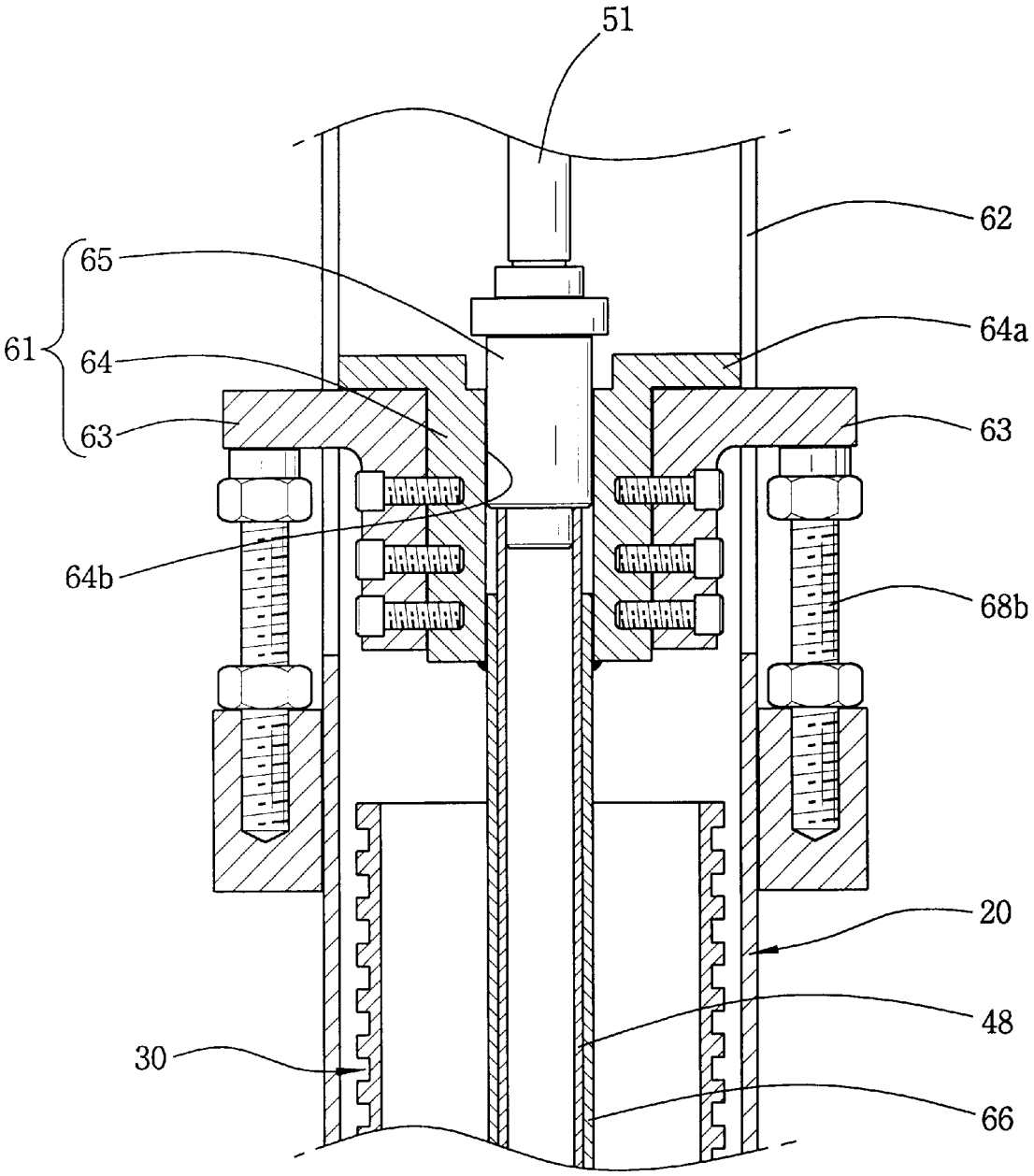
FIG. 9 is an enlarged cross-sectional view of means for limiting a stroke of a hammer according to the present invention.

As shown in FIG. 9, the limiting means 60 includes a plunger unit 61 received in the housing to be positioned over the hammer 30 and to be raised and lowered in a certain range, and a pair of guide slots 62, which are axially formed at the wall of the housing 20 to face each other.

The plunger unit 61 comprises a bush-type body 64 which includes a flange 64*a* having an external diameter corresponding to an internal diameter of the housing 20 and a guide hole 64*b* formed at its center, a connector 65 slidably fitted in the guide hole 64*b* of the body 64 to connect the piston rod 51 of the second hydraulic cylinder 50 to the connecting pipe 48, and a pair of guide protrusions 63 formed on an outer surface of the bush-type body 64 and slidably fitted in the corresponding guide slots 62.

The body 64 of the plunger unit 61 is integrally coupled to the casing 41 of the holding assembly 40 by a joint pipe 66, and is thus raised and lowered together with the holding assembly 40 with a certain spacing therebetween. The body 64 of the plunger unit 61 is adapted to be raised and lowered in a height range corresponding a drop height (75 cm) specified in the standard penetration test.

The body 64 of the plunger unit 61 is securely connected to the casing 41 of the holding assembly 40 by means of a plurality of connecting rods 67.

The housing 20 is provided at its outer surface with a pair of upper stoppers 68*a* and a pair of lower stoppers 68*b* such that the upper stoppers 68*a* are axially spaced from the lower stoppers 68*b*, so as to more stably limit axial movement of the plunger unit 61. The pair of upper stoppers 68*a* and the pair of lower stoppers 68*b* are disposed at positions corresponding to the guide slots 62 of the housing 20, which come into contact with the guide protrusions 63 of the plunger unit 61.

The spacing defined between the upper stoppers 68*a* and the lower stoppers 68*b* is set to equal to the drop height specified in the standard penetration test, and is also set to be smaller than a stroke length of the second hydraulic cylinder 50, so that the pusher unit 43 can be raised and lowered in the casing 41.

The means 70 for counting the number of blows comprises a detection slot 71 formed at an upper portion of the housing 20, and a first sensor 72 mounted on an upper end of the connecting rod 67 projected from the plunger unit 61 to detect the detection slot 71 during axial movement of the plunger unit 61.

The means 80 for measuring a penetration depth of the sampler, comprises a plurality of annular protrusions 81 formed on an outer surface of the hammer 30 at a certain pitch, and a second sensor 82 mounted on a wall of the housing 20 to detect the annular protrusions 81.

The control unit stores various data such as a pitch of the annular protrusions 81 required for a standard penetration test, and controls the action of the hammer 30.

An operation of the automatic hammer system for a standard penetration test according to the present invention will now be described with reference to FIGS. 10*a* to 10*d*.

After a boring operation by the boring equipment 100 is carried out to form a boring hole to a target depth, the drill rod 90, which is connected to the sampler at its lower end, is coupled to an anvil 91, and then inserted into the boring hole. Subsequently, the automatic hammer system is rotated about the support shaft 110 of the boring equipment 100 until the automatic hammer system is precisely positioned over the boring hole, as indicated by dotted lines in FIG. 2.

Figure 10A:
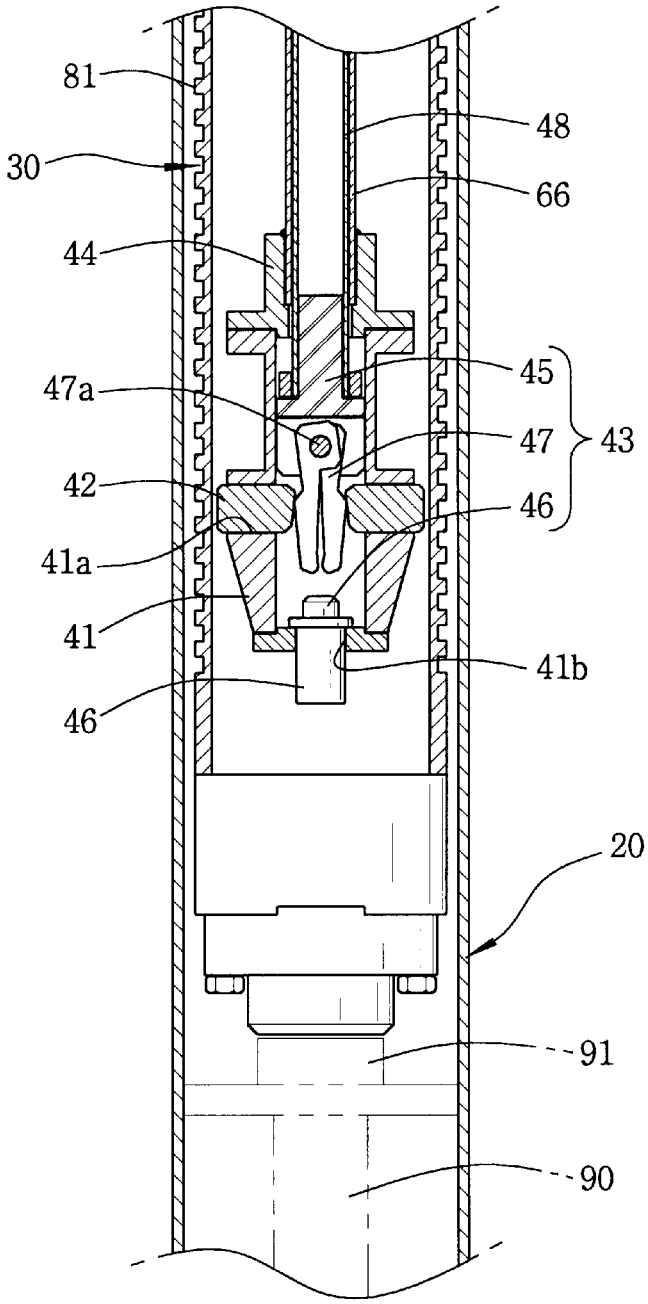
FIGS. 10A to 10D are cross-sectional views showing a holding operation of the holding assembly according to the present invention.

The housing 20 is raised or lowered by activation of the first hydraulic cylinder 10, so that the hammer 30 received in the housing 20 is placed on the anvil 91, as shown in FIG. 10A. The holding assembly 40 is then controlled to be positioned at a lower portion of the holding part 32 of the hammer 30. At this point, the plunger unit 61 of the limiting assembly 60 is disposed at the lowermost position and comes into contact with the lower stoppers 68*b*.

In this state, since the drop head 46 of the holding assembly 40 is hung on the lower end of the casing 41, and is not bitten by the dog 47, the push blocks 42 are not applied with pressing force, so that the hammer 30 is free of engagement with any component.

Thereafter, as the hammer system is driven, the piston rod 51 is lowered by actuation of the second hydraulic cylinder 50. Consequently, the actuating rod 45 of the pusher assembly 43, which is coupled to the piston rod 51 via the connecting pipe 48, is lowered in the casing 41.

Figure 10B:
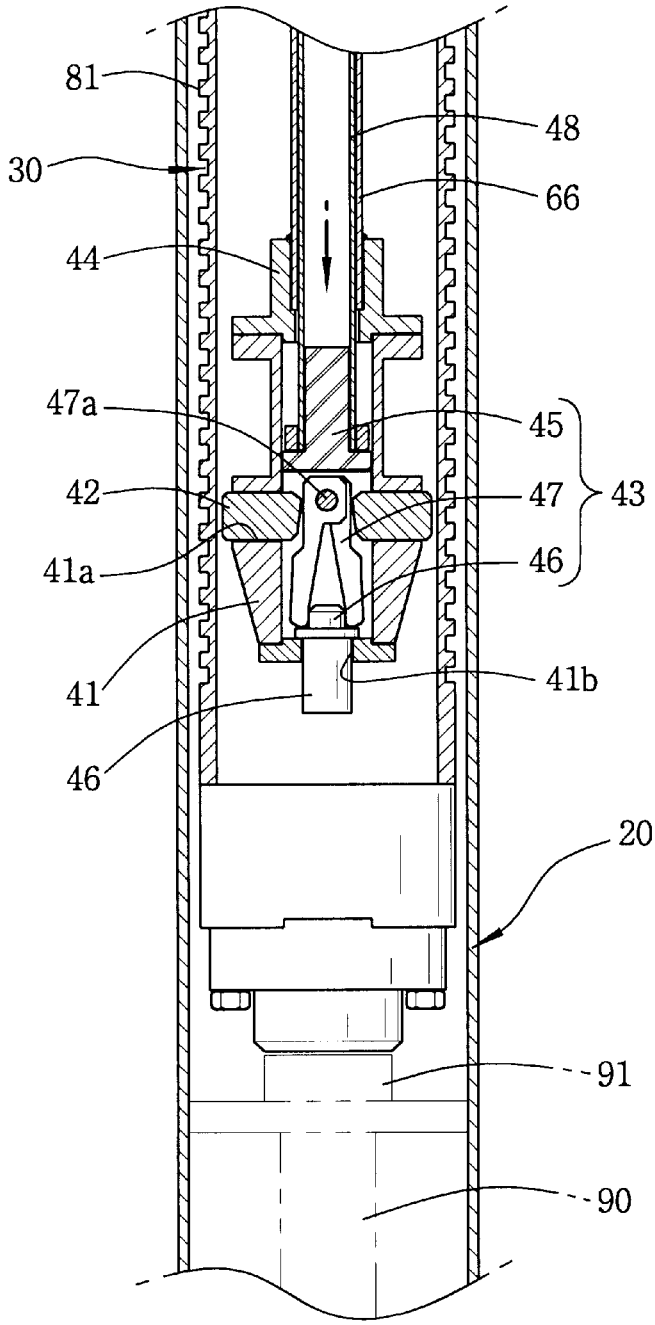

Consequently, the dog 47 pivotally coupled to the lower end of the actuating rod 45 is engaged to the top of the drop head 46 hung on the lower end of the casing 41, and thus opened, followed by biting the drop head 46 by elastic force of the torsion spring, as shown in FIG. 10B.

Figure 10C:
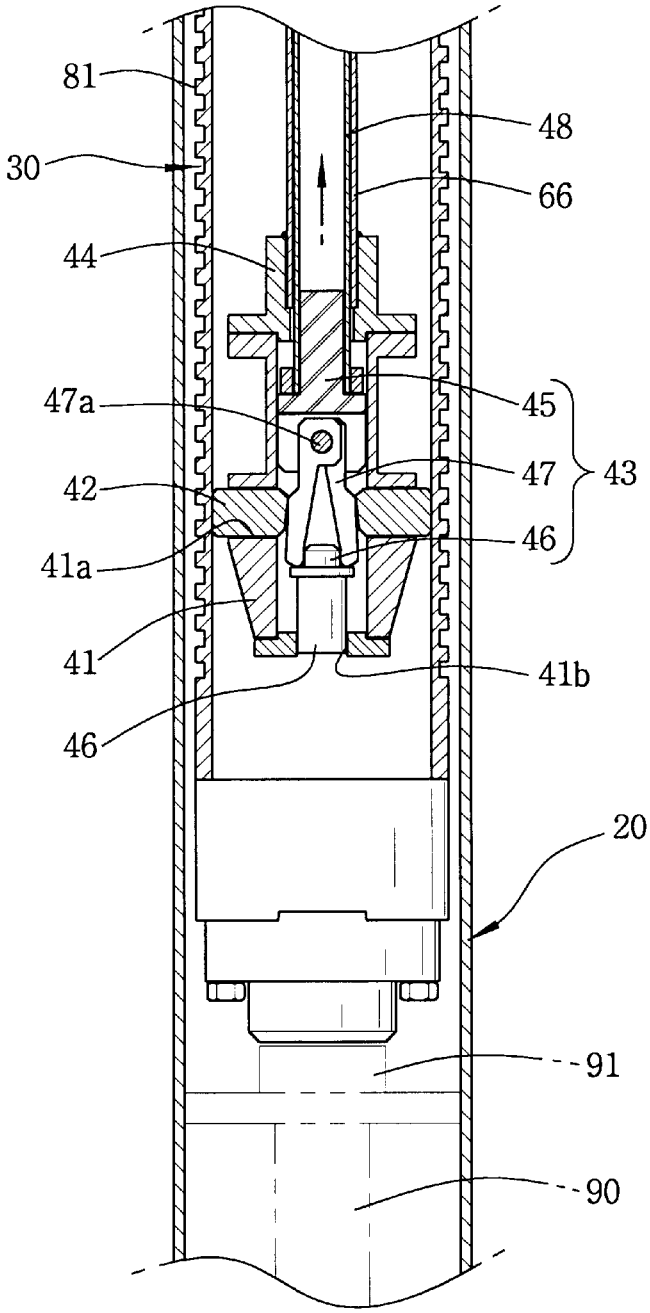

After the drop head 46 is bitten by the dog 47, the piston rod 51 of the second hydraulic cylinder 50 is raised, as shown in FIG. 10C. In this state, since the drop head 46 is merely hung on the hole 41*b* of the casing 41, the drop head 46 is also raised together with the actuating rod 45 in a state of being bitten by the dog 47.

As the dog 47 is raised, the push blocks 42 are radially and outwardly pushed by the opened dog 47, and come into close contact with the inner surface of the hammer 30, as indicated by a phantom line in FIG. 8. Accordingly, the hammer 30 is integrally coupled to the holding assembly 40 via the push blocks 42, and then raised in the housing 20 together with the piston rod 51.

At this point, since the plunger unit 61 disposed over the hammer 30 is connected to the casing 41 of the holding assembly 40 via the joint pipe 66, the plunger unit 61 is also raised therewith.

When the guide protrusions 63 of the plunger unit 61 60 come into contact with the upper stoppers 68*a*, the upward movement of the plunger unit 61 is stopped, and the holding assembly 40 connected to the plunger unit 61 is also stopped at the upper dead point.

When the plunge unit 61 is positioned at the upper dead point, the first sensor 72 of the count means 70 mounted on the connecting rod 67 is positioned to face the detection slot 71 of the housing 20, thereby detecting the detection slot 71. The detection signal is sent to the control unit, so that the control unit counts the number of detections.

At the same time, the second sensor 82 mounted on the wall of the housing 20 detects the number of the annular protrusions 81 passed over the second sensor 82, and sends a signal corresponding to the number to the control unit. More specifically, the second sensor 82 detects the annular protrusions 81 which pass over the sensor 82 during one lifting action of the hammer 30, and send a signal corresponding to the number of the protrusions 81 to the control unit.

Since a stroke length of the piston rod 51 of the second hydraulic cylinder 50 is set to be longer than the spacing between the upper stoppers 68*a* and the lower stoppers 68*b*, the piston rod 51 is further raised even after the guide protrusions 63 of the plunger unit 61 have been caught by the upper stoppers 68*a*.

Figure 10D:
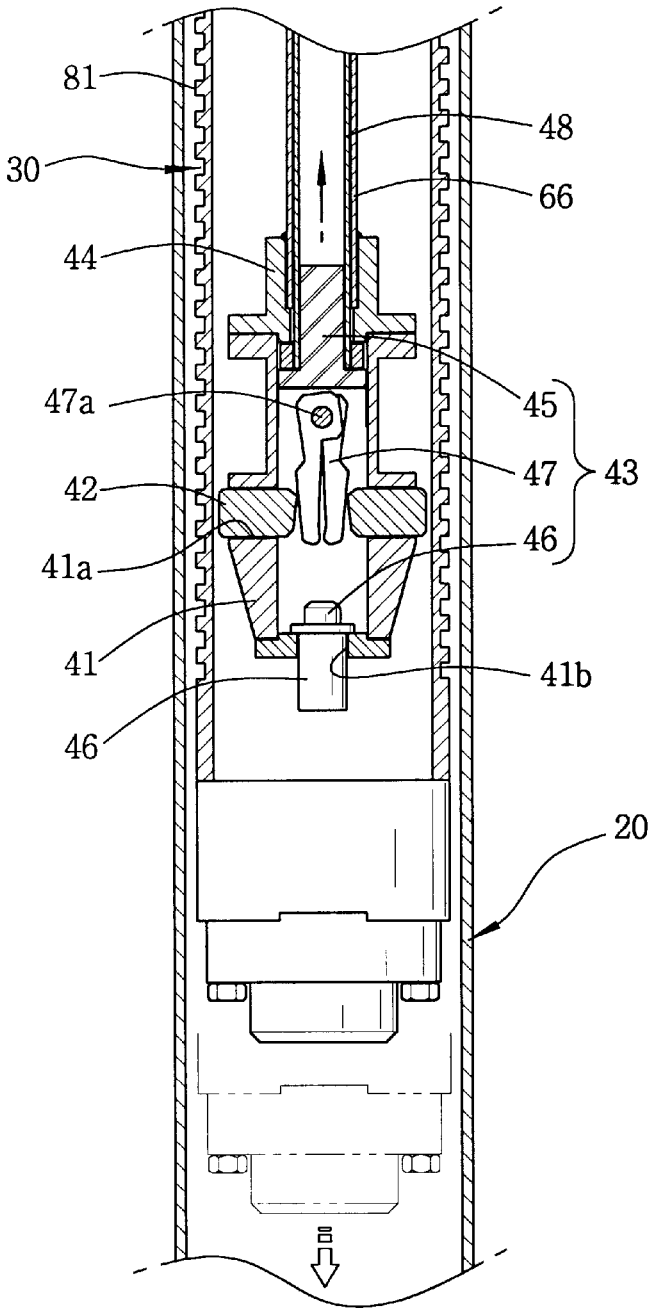

More specifically, since the piston rod 51 passes through the connector 65 slidably fitted in the guide hole 64*b* of the plunger unit 61, and is connected to the actuating rod 45 of the pusher unit 43 via the connecting pipe 48, the piston rod 51 can be further raised until the actuating rod 45 is raised to the top of the casing 41 and thus caught by the cap 44, as shown in FIG. 10D.

In this way, since the actuating rod 45 is further raised after the upward movement of the hammer 30 is stopped, the dog 47 in the casing 41 is raised with respect to the push blocks 42, thereby allowing the drop head 46 to be released from the dog 47.

At this point, since the pressing force applied to the push blocks 42 which are in state of pressing the inner surface of the hammer 30 radially and outwardly is removed, the hammer 30 falls by its own weight and thus impacts against the anvil 91, thereby causing the sampler coupled to the drill rod 90 to penetrate the soil.

After the anvil 91 is applied with a blow by the hammer 5, the piston rod 51 of the second hydraulic cylinder 50 is lowered again, so that the holding assembly 40 is lowered together with the plunger unit 61.

Subsequently, when the guide protrusions 63 of the plunger unit 61 are caught by the lower stoppers 68*b*, the plunger unit 61 and the casing 41 of the holding assembly 40 are stopped but the actuating rod 45 of the pusher unit 43 is further lowered because the actuating rod 45 is connected to the piston rod 51 of the second hydraulic cylinder 50 via the connector 65 of the plunger unit 61 and the connecting pipe 48.

Consequently, the dog 47 is relatively lowered in the casing 41 with respect to the push blocks 42, as shown in FIG. 10A. Thereafter, the dog 47 is opened by forcible engagement with the drop head 46 and thus bites the drop head 46. In this state, as the piston rod 51 is raised, the push blocks 42 are outwardly pushed by the opened dog 47 with a larger width, thereby causing the hammer 30 to be firmly held by the push blocks 42.

At this point, since the inner surface of the hammer 30 is pressed by the push blocks 42 at a position which is disposed to be higher than the previous pressed position by a distance corresponding to a penetration depth by the previous blow, drop heights of the hammer 30 can be maintained at a predetermined value for every blow, regardless of a penetration depth of the sampler.

In other words, since the hammer 30 is held by engagement of its inner surface and the push blocks 42, and a lifting distance of the holding assembly 40 is defined by the upper and lower stoppers 68*a* and 68*b*, a substantial lifting height of the hammer 30 is uniformly maintained even though the hammer 30 is lowered with respect to the hammer system, with only a variation in a holding position of the hammer 30 to which the push blocks 42 are engaged.

Therefore, the automatic hammer system according to the present invention can basically prevent secondary blows generated by lowering of an overall hammer apparatus caused by increase of penetration depth, as in a conventional system.

When the hammer 30 is raised again by the holding assembly 40 as the piston rod 51 of the second hydraulic cylinder 50 is raised, the second sensor 82 mounted on the wall of the housing 20 detects the annular protrusions 81 formed on the outer surface of the hammer 30 which pass over the second sensor 82, and outputs a signal corresponding to the number of the annular protrusions 81.

At this point, the control unit calculates the number of protrusions corresponding to a penetration depth corresponding to one blow by subtracting the current number of the protrusions 81 from the previous number of the protrusions 81, and then finally calculates the penetration depth corresponding to one blow by multiplying the calculated number of protrusions by a pitch of the protrusions.

By accumulating penetration depths obtained in every blow in the above manner, it is possible to conveniently obtain a precise N value.

As described above, the present invention provides an automatic hammer system for a standard penetration test, which enables drop heights of its hammer to be uniformly maintained for every blow, regardless of a penetration depth of the hammer, since the hammer is held at its inner surface by a holding assembly adapted to be raised and lowered in a predetermined distance range.

Furthermore, since the hammer is adapted to be raised to a certain height and then to fall therefrom without lowering displacement of the hammer system, it is possible to reliably prevent secondary blows caused by lowering of a conventional hammer system.

In addition, since the number of blows by the hammer and penetration depths according to the number of blows are automatically calculated and accumulated, an N value can be precisely obtained.

Therefore, the automatic hammer system for a standard penetration test according to the present invention can contribute to improvements in accuracy, reliability and convenience of a standard penetration test.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. An automatic hammer system for a standard penetration test, comprising:

a first vertical hydraulic cylinder rotatably coupled to boring equipment;

a cylindrical housing positioned to be parallel to the first hydraulic cylinder and coupled thereto, the cylindrical housing being connected to a piston rod of the first hydraulic cylinder and adapted to receive therein an anvil of a drill rod, wherein the drill rod is provided at its lower end with a sampler to be inserted in a boring hole of the soil;

a cylindrical hammer with a blind lower end, which is movably received in the housing to be disposed over the anvil;

a holding assembly received in the hammer and adapted to hold the hammer at its lower dead point and to release the hammer at its upper dead point to allow the hammer to fall;

a second hydraulic cylinder concentrically coupled to an upper end of the housing and adapted to raise and lower the holding assembly;

means for limiting a lifting height of the hammer, which is received in the housing to be disposed over the hammer and integrally coupled to the holding assembly with a spacing therebetween, the limiting means being raised and lowered within a certain range;

means for counting the number of blows of the hammer against the anvil;

means for measuring a penetration depth of the sampler by blows of the hammer; and a control unit for carrying out control of the striking action of the hammer and calculation of an N value according to data obtained by the counting means and the measuring means, and for carrying out record and display of test results.

2. The automatic hammer system as set forth in claim 1, in which the holding assembly includes a cylindrical casing which is radially provided at its wall with a plurality of fitting slots at a certain angular spacing, a plurality of holding blocks slidably fitted in the fitting slots of the casing and adapted to selectively press an inner surface of the hammer, and a pusher unit received in the casing and connected to the piston rod of the second hydraulic cylinder, the pusher unit being adapted to outwardly push or release the holding blocks in the course of axial movement.

3. The automatic hammer system as set forth in claim 2, in which the pusher unit includes an actuating rod coupled to the piston rod of the second hydraulic cylinder and adapted to be raised and lowered in the casing, a drop head which is slidably supported to a lower end of the casing, and a dog pivotally connected to a lower end of the actuating rod and adapted to selectively cause the holding blocks to be pushed outwardly and to be released by engagement with and disengagement from the drop head.

4. The automatic hammer system as set forth in claim 2, in which the pusher unit is adapted to outwardly push and release the holding blocks when the pusher unit is further lowered and raised after the limiting means is stopped.

5. The automatic hammer system as set forth in claim 1, in which the limiting means includes a plunger movably received in the housing and integrally coupled to the holding assembly, a plurality of guide slots axially formed at the wall of the housing, and a plurality of guide protrusions provided on an outer surface of the plunger and slidably fitted in the corresponding guide slots.

6. The automatic hammer system as set forth in claim 5, in which the limiting means further includes upper and lower stoppers, which are provided on an outer surface of the housing with a spacing therebetween to limit a moving range of the plunger.

7. The automatic hammer system as set forth in claim 6, in which the spacing between the upper and lower stoppers is set to be smaller than a stroke length of the second hydraulic cylinder.

8. The automatic hammer system as set forth in claim 1, in which the counting means comprises a detection slot formed at an upper portion of the housing, and a first sensor mounted on the plunger to detect the detection slot to count the number of blows by the hammer.

9. The automatic hammer system as set forth in claim 1, in which the measuring means comprises a plurality of protrusions axially formed along an outer surface of the hammer at a certain pitch, and a second sensor mounted on a wall of the housing to detect the number of protrusions passed over the second sensor during every lifting motions, thereby enabling a penetration depth to be obtained from the number of protrusions.

* * * * *